United States Patent [19]

Geschwind

[11] Patent Number: 4,483,518

[45] Date of Patent: Nov. 20, 1984

[54] DEVICE FOR PREVENTING OVERLOAD OF A WINCH

[75] Inventor: Rune L. Geschwind, Vansbro, Sweden

[73] Assignee: Sepson AB, Sweden

[21] Appl. No.: 382,168

[22] Filed: May 26, 1982

[30] Foreign Application Priority Data

Jun. 1, 1981 [SE] Sweden ..... 8103431

[51] Int. Cl.[3] ..... B66D 1/50; B66D 1/22

[52] U.S. Cl. ..... 254/274; 254/344

[58] Field of Search ..... 254/274, 275, 344; 318/475, 467, 469, 433, 434

[56] References Cited

U.S. PATENT DOCUMENTS

| | | | |
|---|---|---|---|
| 2,275,953 | 3/1942 | Frisch | 254/275 |
| 2,280,932 | 4/1942 | Schaelchlin | 254/344 X |
| 2,393,048 | 1/1946 | Mahnke | 254/344 X |
| 2,403,095 | 7/1946 | Lear | 254/275 X |
| 2,414,473 | 1/1947 | Mahnke | 254/344 X |
| 4,175,727 | 11/1979 | Clarke | 254/173 R |

FOREIGN PATENT DOCUMENTS

| | | | |
|---|---|---|---|
| 766634 | 9/1967 | Canada | 254/274 |
| 1226267 | 10/1966 | Fed. Rep. of Germany . | |
| 2823902 | 12/1979 | Fed. Rep. of Germany . | |

*Primary Examiner*—Stuart S. Levy
*Assistant Examiner*—Thomas R. Hannon
*Attorney, Agent, or Firm*—Christel, Bean & Linihan

[57] ABSTRACT

In a device for preventing overload of a vehicle winch, including a line drum, a motor and a planetary gearing between the line drum and the motor, there is a sensor comprising a planet carrier of the planetary gearing. When the winch is overloaded the planet carrier is rotated to a limited extent against the action of a spring force to actuate a switch forming part of the device which interrupts further operation of the winch.

5 Claims, 2 Drawing Figures

DEVICE FOR PREVENTING OVERLOAD OF A WINCH

DESCRIPTION

1. Technical Field

The present invention relates to a device for preventing overload of a winch mounted on a vehicle, for instance. The winch includes a line drum, a motor, a planetary gearing between the motor and the drum and a sensing means coupled to a device which interrupts further operation of the winch when overloaded.

2. Background Art

To prevent overload of winches it has been suggested to use mechanical devices such as safety clutches and breakpins which prevent the winch motor from being overheated or prevent the motor or other elements of the winch from being damaged or destroyed. In the case the motor is electric it has also been suggested to use so called thermo switches which break the current to the motor when the winch motor becomes too hot when overloaded.

The above described devices suffer from certain disadvantages. The mechanical devices are often difficult to set so that they are released at an exactly predetermined pulling force or are difficult to reset in working order after release. Further, they have complicated construction and/or are not especially reliable. The electric thermo switches suffer from several disadvantages and the main disadvantage is that they are not released at a predetermined pulling force but are released only when the winch motor has reached a certain temperature.

DISCLOSURE OF INVENTION

The object of the present invention is to provide a device with which the disadvantages with previously known devices are removed. This object is fulfilled by giving the invention the characteristics stated in the claims.

BEST MODE FOR CARRYING OUT THE INVENTION

Figure 1:
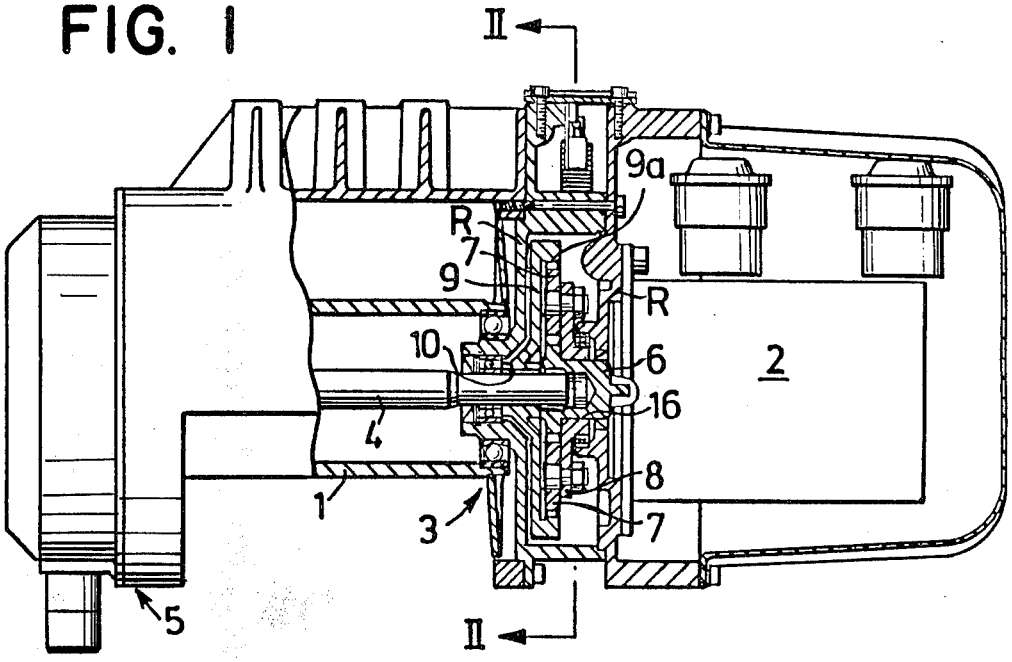
FIG. 1 is a side view, partly in section, of a winch including the device according to the invention.

The winch shown in the Figures, which preferably is mounted on the front bumper of a lorry, includes a line drum 1, an electric continuous-current motor 2 and a gearing which transfers the driving force of the motor to the drum. The gearing is divided into a first gearing 3 between the motor 2 and a shaft 4 extending through the drum and a second gearing 5 between the shaft 4 and the drum. The gearing 5 is a known planetary gearing and will not be described further. The gearing 3 also is a known planetary gearing but has been modified for use in the device according to the invention.

The gearing 3 includes a sun gear 6 driven by the driving shaft of the motor 2. The sun gear is rotatably supported relatively to the winch frame R. The gearing 3 also includes two planet wheels 7 engaging the sun gear and rotatably supported by a planet carrier 8, which is rotatably supported on the sun gear via a slide bearing 16, and a ring wheel 9 having an inner tooth path **9*a* engaging the planet wheels 7. The ring wheel 9 is mounted to the shaft 4 by means of a wedge 10**.

Figure 2:
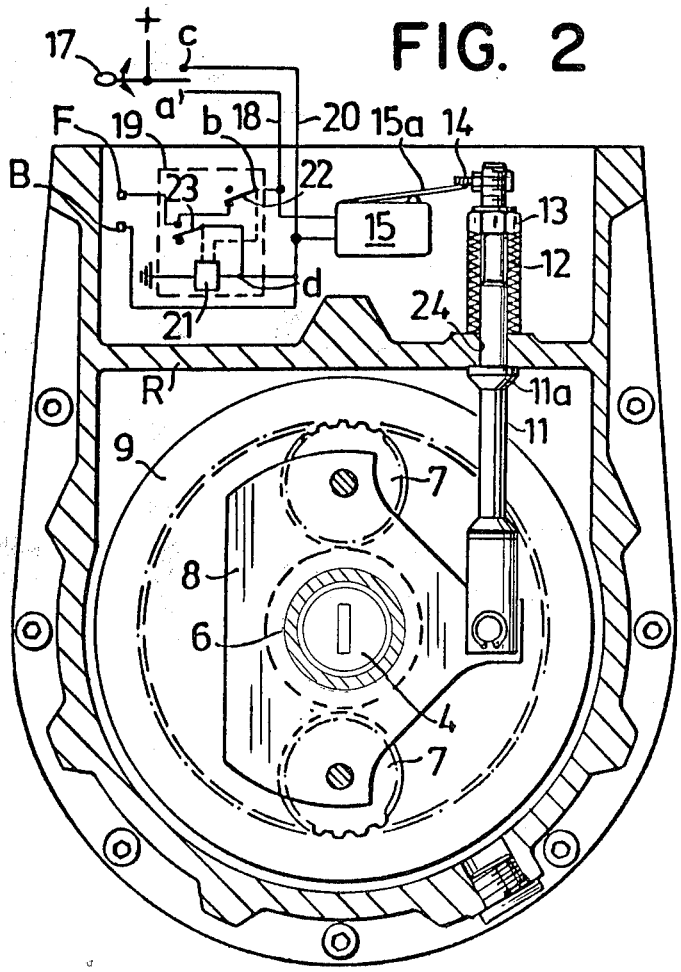
FIG. 2 is a section along line II-II in FIG. 1.

It is evident from FIG. 2 that the planet carrier 8 is rotatably connected to a rod 11 which may be displaced axially in a hole 24 in the frame R. The upper portion of the rod 11 is surrounded by a package 12 of cup springs. The lower end of the package abuts against the winch frame and its upper end abuts against a locking nut 13 fastened to the rod. The package 12 is prestressed and presses the rod 11 upwards to its normal position shown in FIG. 2. The movement upwards is limited by an enlarged portion **11*a* of the rod. This portion abuts against the lower surface of the winch frame. The upper portion of the rod 11 is provided with a screw 14. A contact tongue 15*a* of an electric switch 15 mounted on the winch frame is in contact with the under surface of the screw. The tongue 15*a* assumes the position shown in FIG. 2** during normal pulling work of the winch and in this position it breaks the current in an electric circuit to which the switch is connected.

During the normal pulling work of the winch an electric switch 17 preferably located in the cab of the lorry is set to one of its three possible positions, namely the position wherein a current source is connected to the point of contact a. A line 18 connected to one pole of the switch 15 also connects the point of contact a to a point of contact b of a relay 19 mounted on the winch adjacent its motor 2 and shown with dashed lines in FIG. 2. The other pole of the switch 15 is connected to the point of contact c at the switch 17 via a line 20 and is also connected to a reversing relay B for the winch motor and to a point of contact d in the relay 19. The relay 19 also includes a magnet 21 connected to two tongues 22 and 23. The connection is indicated by means of dashed lines within the relay 19.

If the relay 19 was not present and the switch 15 was directly connected to the winch motor 2 the current to the motor—when the winch is overloaded—would be switched off and thereafter immediately switched on again when the switch 15 switches off the current again at the interruption of the overload. When the switch 15 switches off the current to the motor it is understood that the motor will stop whereby the tension in the line wound around the drum 1 will decrease a little which has the effect that the switch again switches on the current to the motor which starts again and rotates until the switch switches off the current again. By connecting the relay 19 to the switch 15 and the motor the repeated starting and stopping of the motor is avoided during overload.

The course of events during winch overload and the function of the relay 19 will now be described further.

The winch is started by setting the switch 17 to the point of contact a so that current via the line 18, the point of contact b and the tongue 22 is conducted to the relay F which starts the winch motor 2 and rotates it forwards. Because the tongue **15*a* of the switch is unaffected and the current between between the two poles of the switch is switched off no current is flowing through line 20**.

When the pulling force in the line of the winch reaches a predetermined value which is the overload limit for the winch the planet carrier 8 will be rotated clockwise in FIG. 2 around the sun gear in the same direction as the latter is rotated by the motor 2. The reason for this relative rotational movement is that the ring wheel 9 greatly resists rotational movement (the pulling force of the line is transmitted to the ring wheel)

exerted thereon by the sun gear 6 via the planet wheels 7, whereby a part of the rotational movement is taken up by the planet carrier via the planet wheels.

The rotation of the planet carrier 8 takes place against the action of the pressure force in the package 12. If the rotational force on the carrier 8 is sufficiently great the package will be compressed so that the rod 11 is moved downwards in FIG. 2 and the screw 14 on the rod engages the tongue 15*a* so that it switches on the current between the two poles of the switch 15. Current will then flow through line 20 to the reversing relay B of the motor 2, to the point d of the relay 19 and to the magnet 21 which resets the tongues 22 and 23 so that tongue 22 breaks the connection between point b and relay F, whereby the motor stops, and tongue 23 closes the connection between point d and relay F. However, when the tongue 23 is reset the relay F will not be actuated, i.e. switch on the current to the motor, because the current from point d will be connected to ground via the magnet 21. Nor will the relay B be activated for the same reason.

When the cause for the overload has been set aside, i.e. when the pulling force in the line has been decreased to a permissible value, the planet carrier 8 is returned to the position shown in FIG. 2 by means of the package 12, and the current between the poles of the switch 15 is switched off again, but this will not affect the motor because the tongues 22 and 23 are retained in their last described positions. In order to start the winch again the switch 17 first must be reset for a short moment to contact the point of contact c whereby current flows to the point of contact d in the relay 19, so that the magnet 21 is activated and returns the tongues 22 and 23 to the positions shown in FIG. 2, and whereby current also flows to the reversing relay B so that the motor reverses its direction of rotation for a short moment. Then the switch 17 is reset to contact point a and the previous described operation, during which the winch is rotating forwards, will be repeated.

When it is desired to rotate the winch in the backward direction the switch 17 is set to contact the point of contact c so that current is conducted to the relay B independently of whether the switch 15 is actuated or not.

Even though only one embodiment of the invention has been described above and shown on the drawings it should be understood that the invention is not limited to this embodiment but only to what is stated in the claims.

I claim:

1. A device for preventing overload of a winch mounted on a vehicle, for instance, the winch including a line drum, a motor, a planetary gearing between the line drum and the motor and a sensing means coupled to a device, which interrupts further operation of the winch when overloaded, the sensing means including a planet carrier of the planetary gearing, characterized in that the planet carrier is rotatable to a limited extent against the action of a spring force to actuate a switch forming part of the device which interrupts further operation of the winch when the winch is overloaded, and circuit means operatively connected to said switch and to said motor for maintaining the interruption in operation of the winch when overloaded, said circuit means comprising:

(a) a relay having a first state for supplying current to said motor and a second state disconnecting the current supply from said motor, said relay normally being in said first state;

(b) means for connecting said switch to said relay to switch said relay to said second state in response to operation of said switch; and (c) means for resetting said relay to said first state when the cause for the overload has been set aside.

2. A device for preventing overload of a winch mounted on a vehicle, for instance, the winch including a line drum, a motor, a planetary gearing between the line drum and the motor and a sensing means coupled to a device, which interrupts further operation of the winch when overloaded, the sensing means including a planet carrier of the planetary gearing, characterized in that the planet carrier is rotatable to a limited extent against the action of a spring force to actuate a switch forming part of the device which interrupts further operation of the winch when the winch is overloaded and circuit means operatively connected to said switch and to said motor for maintaining the interruption in operation of the winch when overloaded, said circuit means comprising:

(a) a relay having an electromagnet and switch arm and contact means normally in a first state and movable upon energization of said electromagnet to a second state;

(b) a control switch having first and second contacts and an arm for selectively applying a supply of current to either of said contacts, said arm normally engaging said first contact during operation of the winch;

(c) first branch circuit means including said first control switch contact and said relay switch arm and contact means in said first state for supplying current to said motor;

(d) second branch circuit means including said first control switch contact, said switch when actuated in response to overload of the winch, and said relay electromagnet for energizing said electromagnet to move said relay switch arm and contact means to said second state to disconnect the supply of current from said motor; and (e) third branch circuit means including said second control switch contact and said relay electromagnet whereby upon temporary movement of said control switch arm into engagement with said second control switch contact said relay electromagnet is energized to return said relay switch arm and contact means to said first state thereby resetting said relay when the cause for the overload has been set aside.

3. A device according to claim 2, characterized in that the planet carrier is connected to a rod or similar means which, against the action of a spring generating said spring force, is movable to actuate the switch.

4. A device according to claim 1, characterized in that the planet carrier is connected to a rod or similar means which, against the action of a spring generating said spring force, is movable to actuate the switch.

5. A device according to claim 1, wherein said circuit means comprises:

(a) a relay having a winding and switch arm and contact means normally in a first state and movable upon energization or said winding to a second state;

(b) a control switch having first and second contacts and an arm for selectively applying a supply of current to either of said contacts, said arm normally engaging said first contact during operation of the winch;

(c) first branch circuit means including said first control switch contact and said relay switch arm and contact means in said first state for supplying current to said motor;

(d) second branch circuit means including said first control switch contact, said switch when actuated in response to overload of the winch, and said relay winding for energizing said winding to move said relay switch arm and contact means to said second state to disconnect the supply of current from said motor; and (e) third branch circuit means including said second control switch contact and said relay winding whereby upon temporary movement of said control switch arm into engagement with said second control switch contact said relay winding is energized to return said relay switch arm and contact means to said first state thereby resetting said relay when the cause for the overload has been set aside.

* * * * *